United States Patent [19]

Burgess

[11] Patent Number: 4,734,066

[45] Date of Patent: Mar. 29, 1988

[54] TROLLING MOTOR ELEVATING APPARATUS

[76] Inventor: Dennis F. Burgess, Box 142, Henrietta, N.C. 28076

[21] Appl. No.: 39,454

[22] Filed: Apr. 17, 1987

Related U.S. Application Data

[63] Continuation-in-part of Ser. No. 901,632, Aug. 29, 1986.

[51] Int. Cl.[4] ..... B63H 5/12

[52] U.S. Cl. ..... 440/6; 440/54

[58] Field of Search ..... 440/6, 7, 53, 54, 58, 440/59, 60; 254/98–103

[56] References Cited

U.S. PATENT DOCUMENTS

| | | | |
|---|---|---|---|
| 1,124,645 | 1/1915 | Overton | 440/54 |
| 3,187,709 | 6/1965 | Edwards | 440/59 |
| 3,587,512 | 6/1971 | Patterson | 115/41 |
| 3,685,481 | 8/1972 | Mansell | 115/35 |
| 3,980,039 | 9/1976 | Henning | 440/60 |
| 4,226,206 | 10/1980 | Wilson | 440/112 |
| 4,295,385 | 10/1981 | Huttenhów | 74/478 |
| 4,348,193 | 9/1982 | Arndt | 440/62 |
| 4,515,567 | 5/1985 | Wilson | 440/7 |
| 4,527,983 | 7/1985 | Booth | 440/7 |
| 4,529,386 | 7/1985 | Smith | 440/54 |
| 4,587,388 | 5/1986 | Cavin | 220/86.5 |
| 4,610,632 | 9/1986 | Osborne | 440/7 |

*Primary Examiner*—Joseph F. Peters, Jr.
*Assistant Examiner*—Edwin L. Swinehart
*Attorney, Agent, or Firm*—Laurence R. Brown; Alfred J. Mangels

[57] ABSTRACT

An electric trolling motor is journalled by a rotatable shaft into the hull and deck of a fishing boat and a foot control disk on the shaft is positioned on the deck for control of the steering of the boat by a fisherman with both hands employed with a fishing pole. The motor control assembly is simply a motor housing with a shaft extending therefrom for rotatably mounting through the hull of a fishing boat and a disc on the shaft for mounting at deck level for foot control of the shaft rotation by a fisherman in his regular fishing position.

11 Claims, 8 Drawing Figures

TROLLING MOTOR ELEVATING APPARATUS

CROSS-REFERENCE TO RELATED APPLICATIONS

This application is a continuation-in-part of my copending application Ser. No. 901,632, filed Aug. 29, 1986.

TECHNICAL FIELD

This invention relates to electric trolling motors for fishing boats and more particularly it relates to controls for trolling motors by a fisherman without hands when standing in the boat and holding a fishing rod.

BACKGROUND ART

Control systems for electric trolling motors are known in the art. Some of these have attempted to aid a fisherman by providing foot control features. Thus E. Cavin, in U.S. Pat. No. 4,587,388, May 6, 1986 has introduced a remote foot control switch at a fisherman's location for turning on and off the trolling motor. This control system has the deficiency that the direction of trolling cannot be controlled, except by hands on control at the motor location.

J. Booth, in U.S. Pat. No. 4,527,983, July 9, 1985 has introduced a more comprehensive foot control system for electric trolling motors that also controls speed and direction. This depends upon a flexible cable connector from the control box to the motor mount, and includes complex steering controls for the trolling motor. This system is expensive and complex and is difficult to operate and maintain because of the criticality of cable positioning and manipulation.

A further problem of this prior art system is that the cable mechanism need be carefully handled and positioned across the deck of the boats to avoid damage to the cable and to eliminate safety hazards of tripping, etc.

It is therefore a general objective of this invention to provide a simpler low cost foot control system for electric trolling motors that resolves the problems and deficiencies of the prior art.

Other objectives, features and advantages of the invention will be found throughout the following description and accompanying drawings.

DISCLOSURE OF THE INVENTION

This invention substantially simplifies the prior art trolling motor control systems and adds reliability in operation without sacrificing the comprehensive ability to control the trolling motor as to direction and speed by means of a foot control. Thus, a fisherman need not use hands to control the trolling motor.

As a matter of fact this invention provides a simpler and less costly trolling motor configuration than heretofore generally available while at the same time affording the fisherman a foot control medium for direction and speed.

Thus a rotatable foot control pad is supplied for mounting on the boat deck within reach of the fisherman when in fishing position, either sitting or standing. This control pad is directly connected to the electric trolling motor housing by means of a motor position control shaft extending vertically from the motor through the bottom of the fishing boat and rotatable in a suitable bearing affixed in the hull.

A further feature of the invention is that the motor may be lifted and stored close to the boat hull when not used for fishing simply by vertically moving the shaft in the bearing.

BRIEF DESCRIPTION OF THE DRAWINGS

In the various views like reference characters refer to similar features to facilitate comparison.

THE PREFERRED EMBODIMENTS

Figure 1:
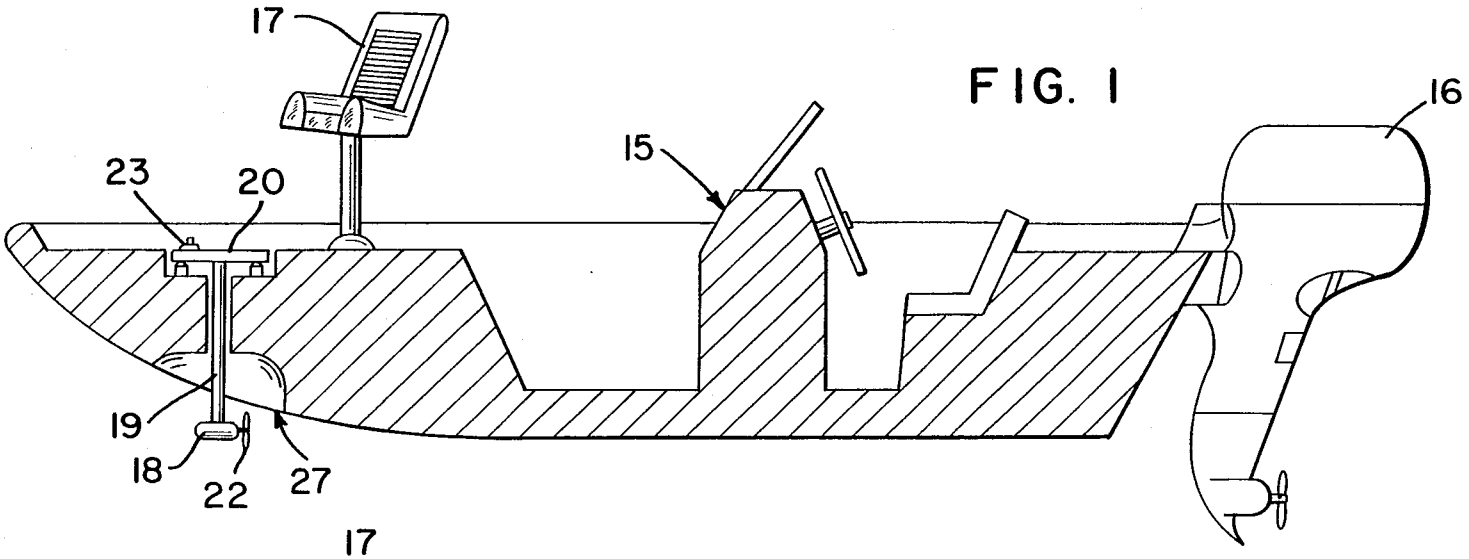
FIG. 1 is a sketch of a partly cut away side view of a bass fishing motor boat embodying the invention.

As may be seen in FIG. 1 the motor boat 15 with the outboard driving motor 16 is of the type sometimes called "bass boats" characterized by a fishing seat 17 above decks near the bow. It is customary when fishing with these boats to have a small electric trolling motor 18 to propell and steer the boat. It is the particular operation of this trolling motor and its mounting in the boat to which this invention is directed.

Figure 2:
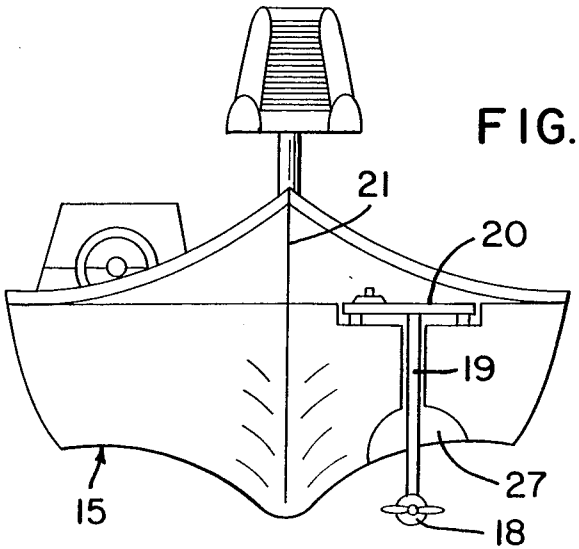
FIG. 2 is a front end view of the boat of FIG. 1.

As may be seen from FIGS. 1 and 2, as diagrammatically shown in cut-away form, the trolling motor 18 has a shaft 19 vertically extending from the motor housing and journalled in the boat to hold the trolling motor 18 horizontally in the water underneath the boat for trolling. A foot control plate 20 is positioned at deck level on one side of the boat center line 21 and near the seat 17 so that a fisherman has access thereto by one foot whether seated or standing. Thus, by foot control the disk 20 may turn the shaft 19 and thus steer the boat when the trolling motor propeller 22 is operating. Also, foot operable controls 23 for starting the motor and for controlling its speed are provided.

Figure 3:
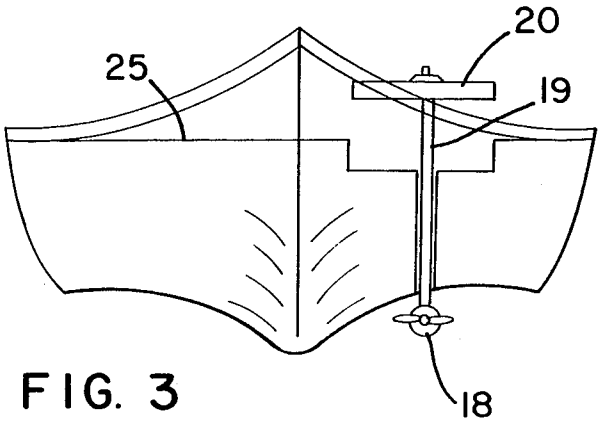
FIG. 3 is a front end view of a further boat embodying the invention.

When the trolling motor 18 is not in use, such as when cruising under power from the outboard motor 16, it is preferably raised to the position shown in FIG. 3, wherein the foot control disc 20 is positioned above the deck 25 by vertically extending the shaft 19 to position the electric trolling motor 18 adjacent the boat hull bottom. As shown in FIGS. 1 and 2, the boat 15 may have a recessed compartment 27, for receiving the motor, in the manner set forth in U.S. Pat. No. 4,226,206, Oct. 7, 1980 to J. E. Wilson for Retractable Propulsive Means for Small Boats, for example.

Figure 4:
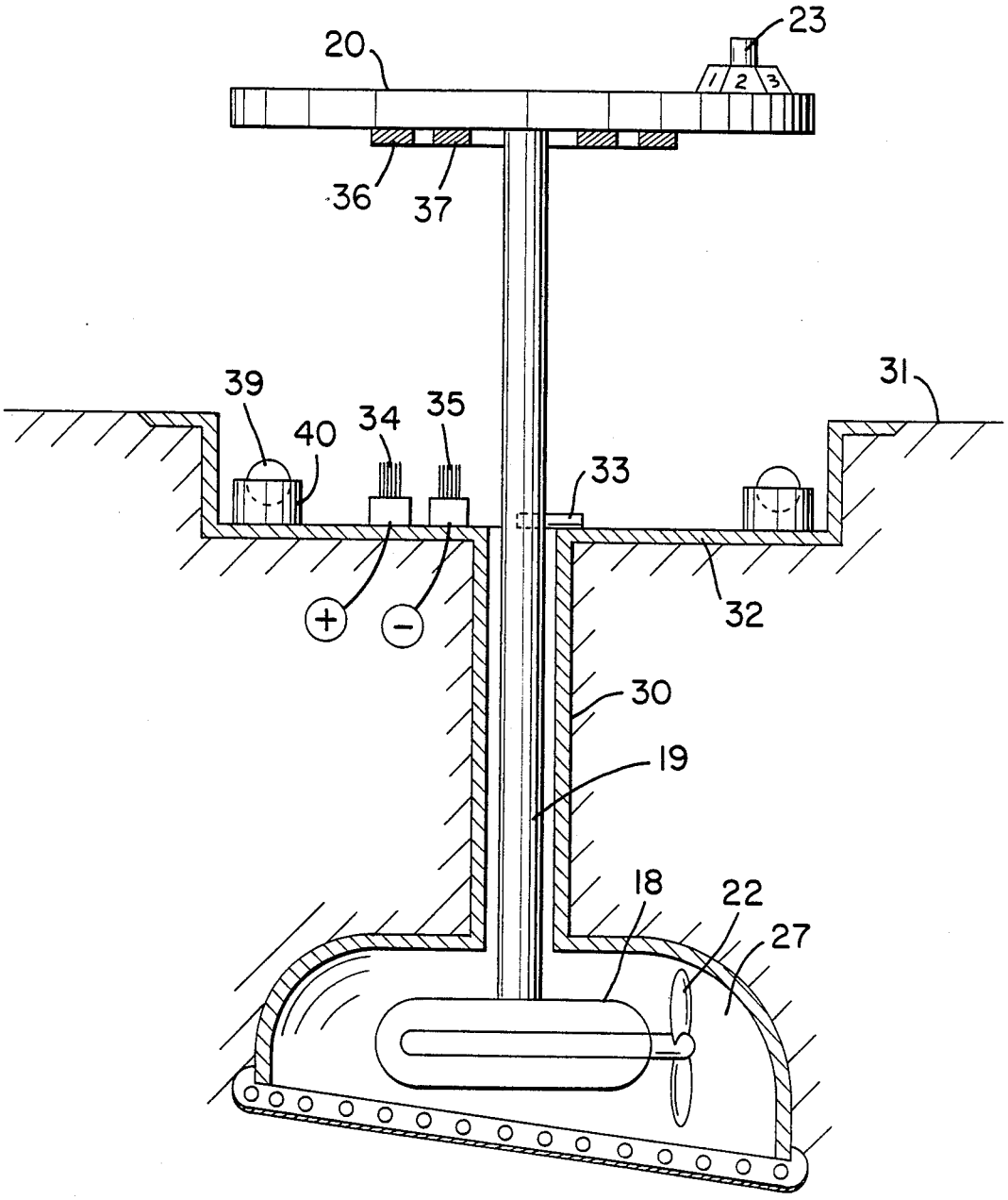
FIG. 4 is an elevation view, partly in section, of a trolling motor assembly embodying the invention positioned in stand by storage position.

FIG. 4 shows a typical trolling motor assembly for installing on a boat in such a manner, having the compartment 27 for receiving the motor-propeller assembly 18–22. The shaft housing 30 has the motor shaft 19 journalled therein for rotation and in this embodiment is fashioned to fit in the recess below deck 31 provided by the cylindrical receptacle 32 for the foot control disc 20. The motor is held up in the stowed position shown by the detent pin 33 in the shaft 30, or equivalent mechanism.

When the motor is lowered into the water in trolling position, the brushes 34, 35 contact slip rings 36, 37 on the foot control disc 20, so that the trolling motor may be turned on and off and its speed controlled by foot contact with the motor control switching means 23. Only one wire may be necessary if the motor case and shaft and one battery connection are grounded. A control wire cable is run inside shaft 19 from the switching means 23 to the motor housing 18.

Figure 5:
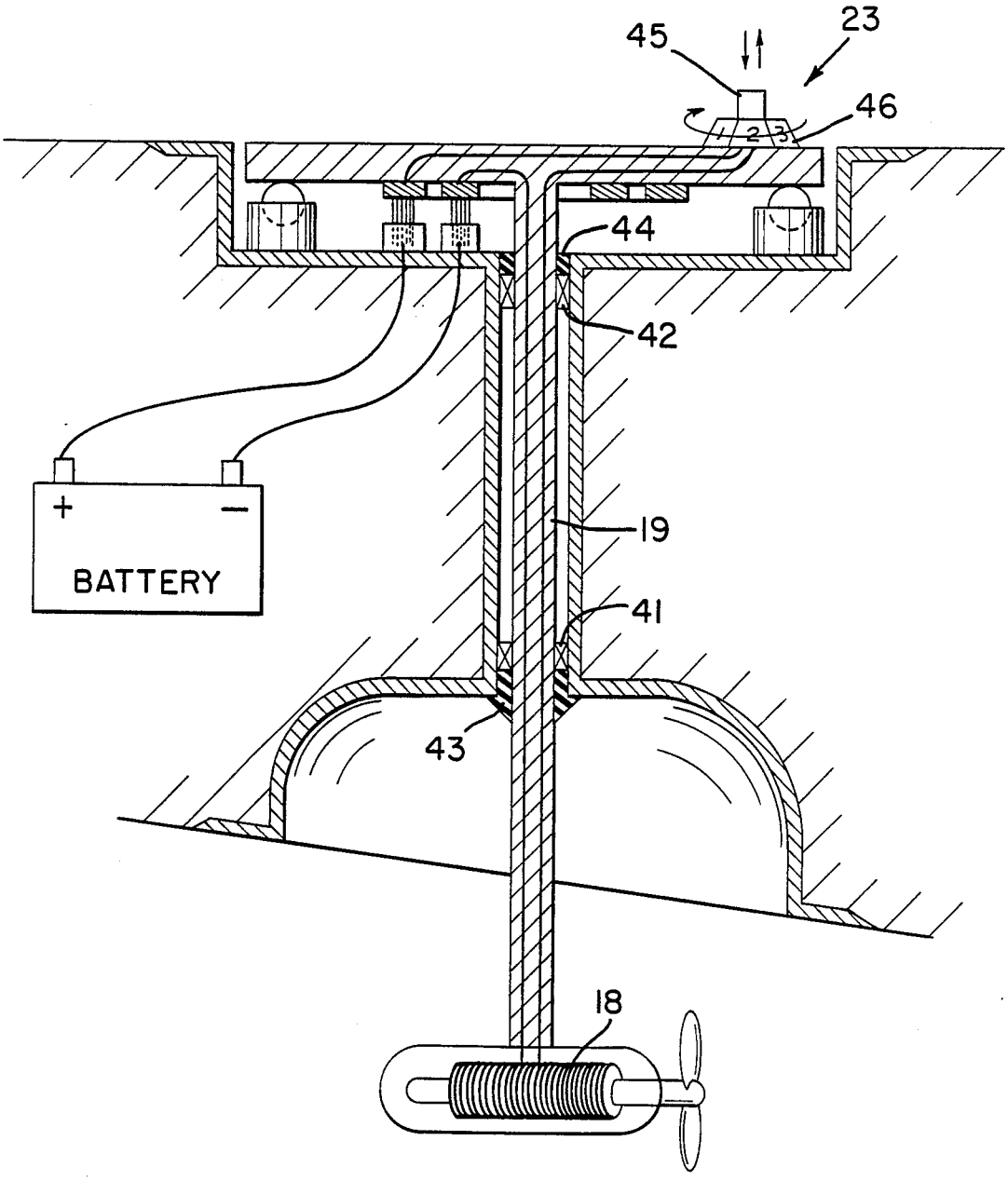
FIG. 5 is a further elevation view embodiment of the invention with the trolling motor assembly shown in operating position.

Note also that a set of roller bearings 39 may be distributed about the receptacle in retainers 40 for engaging the bottom side of disk 20 as it is rotated to control the steering of the boat. As better seen from FIG. 5, the shaft 19 is journalled for rotation by bearings 41, 42, and water seals 43, 44 are provided. The motor switching control means 23 may comprise an off-on toggle switch button 45 and a rotatable switching member 46 for connecting in resistors or otherwise controlling the speed of the motor 18.

Figure 6:
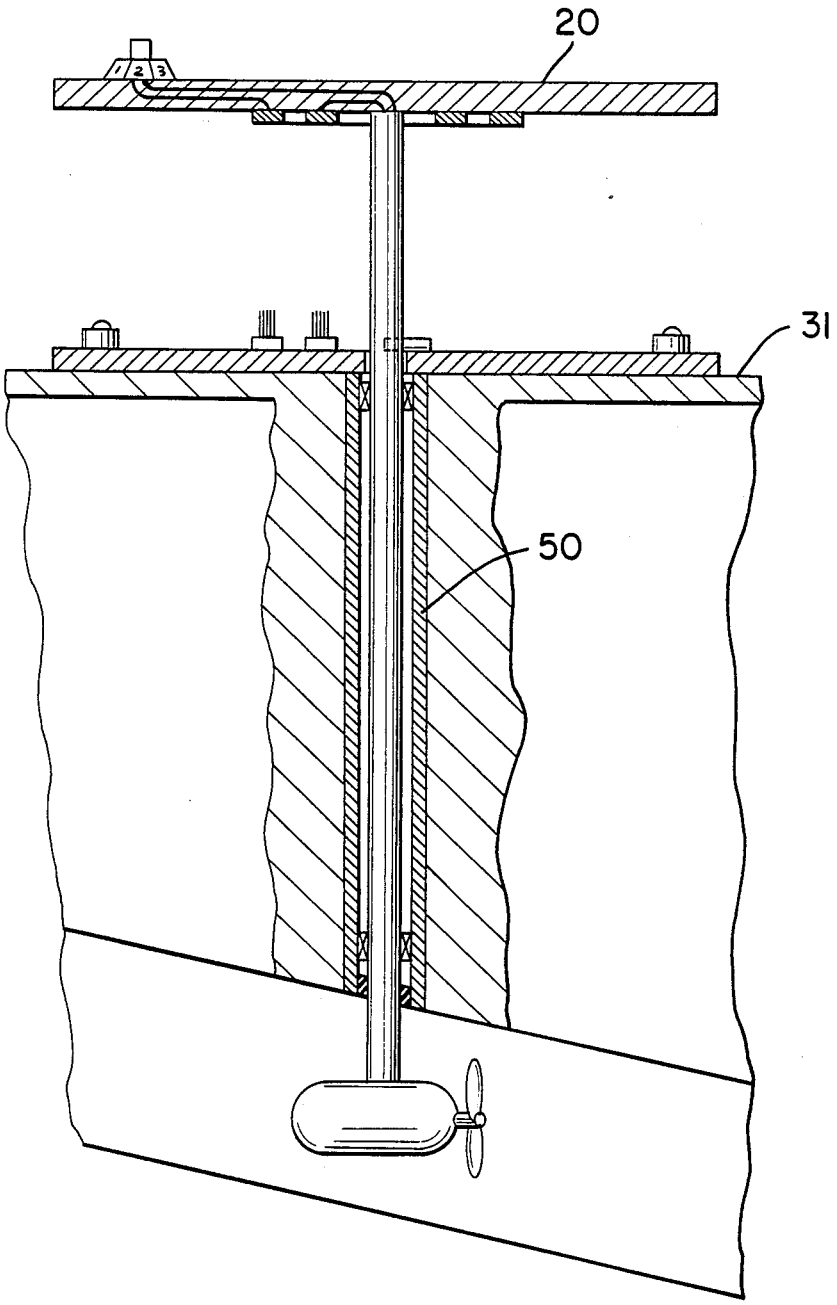
FIG. 6 is an elevation view of a simplified embodiment of the invention comprising a fragmentary section of a boat cut away in section to show the installation of a trolling motor.

In FIG. 6 a simpler construction with a small diameter hole and shaft 50 installed in the deck 31 is shown with the foot control disk 20 extending slightly above the deck level. Note that prior art trolling motors have not been mounted through the hull, nor have foot control disks been mounted directly on a rotatable motor control shaft.

Figure 7:
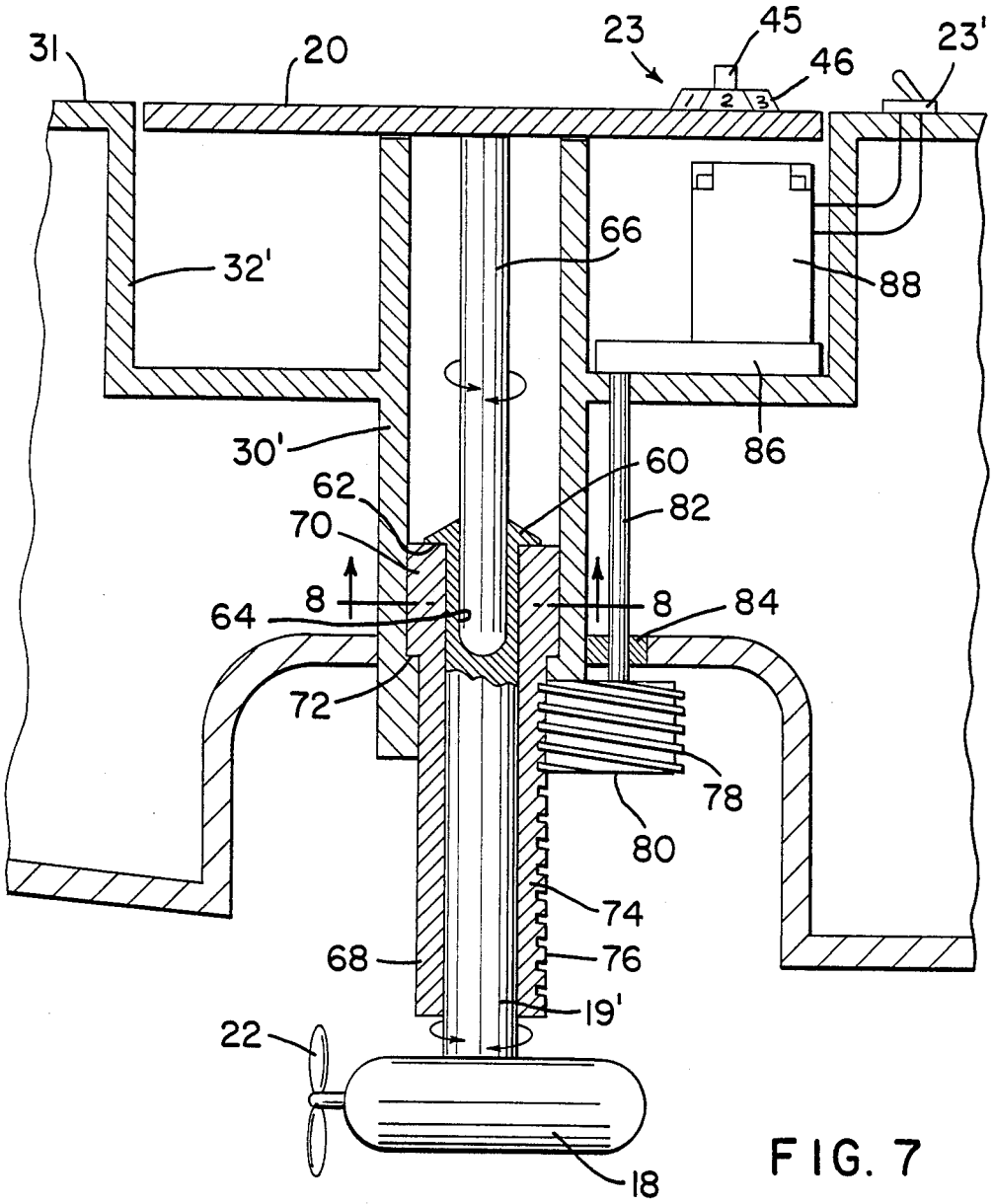
FIG. 7 is a fragmentary cross-sectional view of another embodiment of the present invention.

A further embodiment of the present invention is illustrated in FIG. 7, in which the foot control plate 20 is maintained at a predetermined vertical position relative to the deck 31 of the boat. Instead of being manually raised or lowered, trolling motor housing 18 is raised or lowered by means of an electrically-powered drive system. In the embodiment illustrated in FIG. 7, the elements that are the same as those in the previously-described embodiments have the same reference numerals, and those elements that are similar to but structurally different from the corresponding elements in the previously-described embodiments have primed reference numerals.

From a structural standpoint, the embodiment of FIG. 7 includes a shaft housing 30' that extends into cylindrical receptical 32' recessed below the level of deck 31. Shaft housing 30' is a cylindrical housing that vertically upwardly extends from compartment 27 in hull lower surface 15 through cylindrical receptical 32' to terminate at a point below the level of deck 31. Foot control plate 20 rests on the upper edge of shaft housing 30', which can, if desired, carry anti-friction bearings, or, alternatively, can be provided with a low friction surface in order to permit plate 20 to rotate freely with respect to shaft housing 30'. Alternatively, the bearing arrangement illustrated in FIG. 4, involving a roller bearing such as bearing 39 and a bearing retainer such as retainer 40 can also be employed, if desired. Foot control plate 20 also carries a trolling motor control switch in the form of a foot operable control 23 that includes on/off button 45, and rotatable switching member 46 for controlling the trolling motor speed, and is also similar to the corresponding elements shown in FIGS. 4 and 5.

Trolling motor housing 18 includes motor support rod 19', which extends outwardly from housing 18 in an upward direction substantially perpendicular to the axis of rotation of propeller 22. Rod 19' terminates in a head 60 that is of substantially mushroom shape and includes an outwardly extending shoulder 62. An inner bore 64 coaxial with the axis of rod 19' extends into the rod through the head end thereof to axially slidably receive foot control plate support shaft 66. Although axially slidable relative to each other, rod 19' and shaft 66 are so interconnected as to be rotatable together, so that rotation of foot control plate 20 about the axis of shaft 66 also rotates support rod 19' and trolling motor housing 18.

Surrounding motor support rod 19' to permit relative rotation therewith is adjustable sleeve 68 that is axially slidably carried in shaft housing 30'. Sleeve 68 includes a stepped head end 70 of greater diameter than that of the body of sleeve 68. Head end 70 is axially slidably carried in the cylindrical inner bore of housing 30' and engages an inwardly extending shoulder 72 in housing 30' at the lower end thereof, which limits downward movement of sleeve 68 relative to housing 30'. Although sleeve 68 is axially slidable within housing 30', it is not capable of relative rotation therewith.

The outer surface of sleeve 68 includes a rack 74 comprising a plurality of axially spaced, transversely extending teeth 76, that are engageable with cooperating helical teeth 78 on a sleeve drive worm gear 80 that is in meshing engagement with rack 74. As shown in FIG. 7, the axis of rotation of pinion 80 is parallel with the axis of sleeve 68.

Drive worm gear 80 is carried on drive shaft 82 that is rotatably carried in drive shaft support 84 and in the base of cylindrical receptacle 32', respectively. Drive shaft 82 is suitably connected with a suitable reduction gear train 86 carried within receptacle 32', which gear train is driven by an electically powered drive motor 88, also received within receptacle 32'. Drive motor 88 is controlled by a foot operated three position switch 23', which controls the supply of power from a battery (not shown) to drive motor 88. Switch 23' is mounted on the deck 31 and preferably has three positions, off, up, and down, to control the elevation of trolling motor housing 18 relative to the hull lower surface 15.

Figure 8:
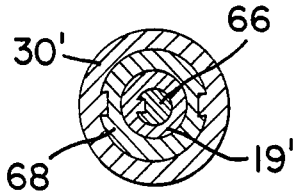
FIG. 8 is a cross-sectional view taken along the line 8—8 of FIG. 7.

As best seen in FIG. 8, control plate shaft 66 is non-rotatably engaged with motor support rod 19' so that the two rotate together, although they are capable of relative axial sliding movement. Similarly, height adjustment sleeve 68 and shaft housing 30' are also non-rotatably interconnected, although they are capable of relative axial sliding movement as well. However, motor support rod 19' is both axially and rotatably movable relative to height adjustment sleeve 68.

In operation, the embodiment shown in FIGS. 7 and 8 permits foot-operated control of the position of trolling motor housing 18 relative to hull lower surface 15. In the uppermost position, motor housing 18 and propeller 22 are received within compartment 27, when operation of the trolling motor is not desired. However, when it is desired to use the trolling motor, switch 23' is operated by the foot of the fisherman from the off position to the down position, to energize drive motor 88 and thereby rotate drive shaft 82 through reduction gear train 86. Drive shaft 82 turns drive worm gear 80 which, in turn, causes height adjustment sleeve 68 to extend from housing 30' in a downward direction until trolling motor housing 18 is at the desired downward extension relative to hull lower surface 15, whereupon switch 23' is returned to the off position. Trolling motor housing 18 is then in the extended position illustrated in FIG. 7. The operation of the trolling motor can then be controlled through switches 45 and 46 in the same manner as hereinabove described with respect to the embodiment of FIGS. 4 and 5.

When it is desired to retract trolling motor housing 18 into compartment 27, switch 23' is moved from the off position to the up position, which reverses the direction of rotation of drive motor 88 from the direction of rotation during the motor extension or lowering operation, to thereby rotate drive pinion 80 in the opposite direction and cause height adjustment sleeve 68 to be drawn upwardly into shaft housing 30' and thereby carry motor support rod 19', and consequently trolling motor housing 18, upwardly relative to hull lower surface 15. When the motor is in the desired position relative to the hull, switch 23' is moved into the off position once again.

It is therefore evident that this invention has improved the state of the art in bass fishing and trolling by simplifying the nature of trolling motor control by the fisherman and by simplifying and reducing the complexity of the control system for trolling motors. Those novel features descriptive of the nature and spirit ot this invention are defined with particularity in the following claims.

What is claimed is:

1. A trolling motor drive apparatus for a fishing boat and operable by the foot of a fisherman, said apparatus comprising:

a. a trolling motor housing including a submersible electrically operated motor for driving a propeller rotatably supported by said housing;

b. motor housing support means carried on a fishing boat hull for supporting said motor for movement toward and awary from the hull of the boat, said motor housing support means including rod means extending from said motor housing, sleeve means including a bore for rotatably receiving said rod means, said sleeve means including external rack means and said housing support means including drive gear means in meshing engagement with said rack means, housing means having a bore for axially slidably receiving said sleeve means, and actuating means rotatably supported by the boat hull and non-rotatably connected with said rod means for pivoting said motor housing about a substantially vertical axis;

c. drive means carried in the boat for moving said housing support means, said drive means drivingly connected with said drive gear means to selectively cause said sleeve to move telescopically into and out of said housing; and d. foot operable control means carried on the boat for selectively controlling said drive means to change the position of the motor housing relative to the boat hull.

2. Trolling motor drive apparatus in accordance with claim 1, wherein said drive means includes a drive motor and a reduction gear train connected to said drive motor and to said housing support means to move said trolling motor toward and away from the hull of the boat.

3. Trolling motor drive apparatus in accordance with claim 1, wherein said rod means includes a first end connected with said trolling motor housing and a second end including a laterally outwardly extending head, said head engageable with an end of said sleeve means for limiting axial extension of said rod means relative to said sleeve means.

4. A trolling motor in accordance with claim 1, wherein said drive gear means is a worm gear.

5. Apparatus for extending and retracting a trolling motor relative to a recessed compartment in the hull of a fishing boat, said apparatus comprising:

a. rod means having an end connected with a trolling motor housing;

b. sleeve means for axially slidably and rotatably receiving said rod means;

c. housing means carried in the boat hull for axially slidably and non-rotatably receiving said sleeve means; and d. drive means carried in said boat hull for axially moving said sleeve means relative to said housing means, wherein said sleeve means includes an external rack and said housing means carries a drive gear means in meshing engagement with said rack, and said drive means is drivingly connected with said drive gear means to selectively cause said sleeve to move telescopically into and out of said housing.

6. Apparatus in accordance with claim 5, wherein said drive means includes a drive motor and a reduction gear train connected to said drive motor and to said housing means to move said trolling motor toward and away form the hull of the boat.

7. Apparatus in accordance with claim 5, wherein said drive means includes a drive motor and a reduction gear train connected to said drive motor and to said housing means to move said trolling motor toward and away from the hull of the boat.

8. Apparatus in accordance with claim 5, wherein said rod means includes a first end connected with said trolling motor housing and a second end including a laterally outwardly extending stop, said stop engageable with an end of said sleeve means for limiting axial extension of said rod means relative to said sleeve means.

9. Apparatus in accordance with claim 5, wherein said drive gear means is a worm gear.

10. Apparatus for extending and retracting a trolling motor relative to a boat hull, said apparatus comprising:

a. a trolling motor housing including a submersible electrically operated motor for driving a propeller rotatably supported by said housing;

b. motor housing support means carried on a fishing boat hull for supporting said motor for movement toward and away from the hull of the boat, wherein said motor housing support means includs rod means extending from said motor housing, sleeve means including a bore for rotatably receiving said rod means, housing means having a bore for axially slidably and non-rotatably receiving said sleeve means, and actuating means rotatably supported by the boat hull and non-rotatably connected with said rod means for pivoting said motor housing about a substantially vertical axis;

c. drive means carried on the boat for moving said housing support means, the drive means including a drive motor, a drive shaft drivingly connected with the drive motor and having its' axis substantially parallel to to the rod means axis, and gear means between the drive shaft and the sleeve means for drivingly connecting the drive shaft with the sleeve means; and d. foot operable control means carried on the boat for selectively operating the actuating means.

11. Trolling motor drive apparatus in accordance with claim 10, wherein said drive means includes a drive motor and a reduction gear train connected to said drive motor and to said housing support means to move said trolling motor toward and away from the hull of the boat.

* * * * *